US005778337A

United States Patent [19]

Ireton

[11] Patent Number: 5,778,337

[45] Date of Patent: Jul. 7, 1998

[54] DISPERSED IMPULSE GENERATOR SYSTEM AND METHOD FOR EFFICIENTLY COMPUTING AN EXCITATION SIGNAL IN A SPEECH PRODUCTION MODEL

[75] Inventor: Mark A. Ireton, Austin, Tex.

[73] Assignee: Advanced Micro Devices, Inc., Sunnyvale, Calif.

[21] Appl. No.: 643,522

[22] Filed: May 6, 1996

[51] Int. Cl.[6] ..... G10L 5/00

[52] U.S. Cl. ..... 704/223; 704/211

[58] Field of Search ..... 395/2.12, 2.13, 395/2.2, 2.23, 2.26, 2.28, 2.32

[56] References Cited

U.S. PATENT DOCUMENTS

| | | | |
|---|---|---|---|
| 4,544,919 | 10/1985 | Gerson | 341/75 |
| 4,771,465 | 9/1988 | Bronson et al. | 395/2.16 |
| 4,797,926 | 1/1989 | Bronson et al. | 395/2.23 |
| 4,817,157 | 3/1989 | Gerson | 341/75 |
| 4,896,361 | 1/1990 | Gerson | 395/2.31 |
| 4,937,873 | 6/1990 | McAulay et al. | 395/2.74 |
| 5,081,681 | 1/1992 | Hardwick et al. | 395/2.77 |
| 5,327,518 | 7/1994 | George et al. | 395/2.2 |
| 5,359,696 | 10/1994 | Gerson et al. | 395/2.32 |
| 5,504,833 | 4/1996 | George et al. | 395/2.2 |

OTHER PUBLICATIONS

ICASSP 82 Proceedings, May 3, 4, 5, 1982, Palais Des Congres, Paris, France, Sponsored by the Institute of Electrical and Electronics Engineers, Acoustics, Speech, and Signal Processing Society, vol. 2 of 3, IEEE International Conference on Acoustics, Speech and Signal Processing, pp. 651–654.

*Primary Examiner*—Allen R. MacDonald
*Assistant Examiner*—Susan Wieland
*Attorney, Agent, or Firm*—Conley, Rose & Tayon; Jeffrey C. Hood

[57] ABSTRACT

A vocoder for generating speech from a plurality of stored speech parameters which computes the excitation signals in the speech production model. The present invention generates a periodic excitation signal with flat frequency response and linear group delay. The present invention uses properties of the phase delay sequence being generated to calculate each of the parameters of the excitation signal in an efficient and optimized manner. Generation of the excitation signal requires computation of the expression:

$$y(x) = \sum_{I=1}^{0.4375P} \cos(\phi_I(x)) \quad (1)$$

The above expression uses the equation:

$$\phi_I'(x)^* = \frac{Ix}{P} - \frac{k''I^2}{P^2} \quad (2)$$

This equation defines the phase relationship between the signals using a linear group delay where $\phi'_I(x)^*$ is the absolute phase offset from the first phase harmonic, I is an index for the harmonic, x is time, P is the pitch period, and k" is a constant. The present invention performs the following iterations to compute the above sequence:

1) $\phi'_I(x)^*=\phi'_{I-}(x)^*+A_{I-1}(x)$
2) $A_I(x)=A_{I-1}(x)-B$ where $A_1$ values are the relative phase differences between consecutive harmonics; the $\phi'_I(x)^*$ values are the absolute phase offsets from the first phase harmonic; B is a constant of 2 $k''/P^2$, x is the time, and I is the iteration number. After the phase offset values have been computed, cosines of the plurality of phase offset values are computed and summed to produce the excitation signal. The excitation signal is then used in a speech production model to generate speech.

27 Claims, 10 Drawing Sheets

Representation of Speech Signals

Range of bit rates for various types of speech representations.

Source-system model of speech production

General discrete-time model for speech production

Block diagram of simplified model for speech production

DISPERSED IMPULSE GENERATOR SYSTEM AND METHOD FOR EFFICIENTLY COMPUTING AN EXCITATION SIGNAL IN A SPEECH PRODUCTION MODEL

FIELD OF THE INVENTION

The present invention relates generally to a voice production model or vocoder for generating speech from a plurality of stored speech parameters, and more particularly to a system and method for efficiently generating a periodic excitation signal with flat frequency response and linear group delay to produce more naturally sounding reproduced speech.

DESCRIPTION OF THE RELATED ART

Digital storage and communication of voice or speech signals has become increasingly prevalent in modern society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

One key aspect for reproducing speech from a parametric representation involves the impulse train produced by the impulse train generator and which is provided to the glottal pulse model. The traditional technique for generating the impulse train comprises generating a series of periodic impulses separated in time by a period which corresponds to the pitch frequency of the speaker. A typical such sequence is illustrated in FIG. 6. Specifically, if f is the pitch frequency of the speaker then p=1/f is the time period between impulses. It is noted that, for an all digital system, p is restricted to be some multiple of the sampling interval of the system.

According to Fourier theory, the frequency spectrum of a periodic impulse train, as described above, is also a set of impulses in the frequency domain. As shown in FIG. 7, the frequency domain pulses are separated by f Hz and are scaled by 1/p. The phase relationship between all of the components or impulses is zero, indicating that the impulses are all aligned at time 0.

In practice, the frequency spectrum of a speech waveform is band limited. The effect in the time domain of band limiting in the frequency domain is to spread out the impulses in time. Specifically, if an ideal low pass filter is used, then each impulse in the time signal of FIG. 6 is replaced by a "sinc" function. (sinc x=(sinπx/πx)). The form of a sinc function is shown in FIG. 8. The width of the central pulse is related to the cut off point of the low pass filter, and the actual width of the pulse w is much less than p for a typical speech application. FIG. 9 illustrates a band limited version of the pulses of FIG. 6. The pulses in FIG. 9 are similar to the pulses in FIG. 6, except that the width of the pulses in FIG. 9 are not infinitesimal.

The conventional type of excitation using an impulse train has several drawbacks. First, an impulse train excitation signal provided to the glottal pulse model does not accurately model natural speech. The excitation from the glottis, in real speech, is more spread out over time than an impulse train. As a result, speech reconstructed from this type of excitation sounds tense and unnatural. Second, concentrating all of the energy into a narrow pulse causes numeric problems in a fixed point arithmetic implementation.

These problems are overcome by applying a constant phase distortion to the excitation signal, as shown in FIG. 10. This technique applies a delay to each frequency (harmonic) component that is directly proportional to the frequency of the harmonic. A technique for improving the quality of speech for an LPC type vocoder by adjusting the phase spectrum of the excitation has been presented by Kang & Everett, "Improvement of the Narrowband Linear Predictive coder Part 2—Synthesis Improvements," NRL Report 8799, Jun. 11, 1984. This method uses a linear group delay which spreads out the frequency components, and thus disperses the pulses in the time domain.

However, the computation of the delay component for each harmonic requires considerable processing power. Therefore, improved methods are desired which more efficiently compute the excitation signal in a speech production model.

SUMMARY OF THE INVENTION

The present invention comprises a vocoder for generating speech from a plurality of stored speech parameters which efficiently computes the excitation signals in the speech production model. The present invention efficiently generates a periodic excitation signal with flat frequency response and linear group delay. The present invention uses properties of the phase delay sequence being generated to calculate each of the parameters in an efficient and optimized manner.

The system preferably comprises a digital signal processor (DSP) and also preferably includes a local memory. The system also preferably includes a voice coder/decoder (codec). During encoding of the voice data, the voice codec receives voice input waveforms and generates a parametric representation of the voice data. A storage memory is coupled to the voice codec for storing the parametric data. During decoding of the voice data, the voice codec receives the parametric data from the storage memory and reproduces the voice waveforms. A CPU is preferably coupled to the voice codec for controlling the operations of the codec. The system may also be coupled to digital input and/or output channels and adapted to receive and produce digital voice data.

During the decoding process, the present invention produces an excitation signal with phase distortion which is supplied to a glottal pulse model. The excitation signal requires the calculation of a plurality of phase offsets. More particularly, generation of the excitation signal requires computation of the equation:

$$y(x) = \sum_{I=1}^{0.4375P} \cos(\phi_I(x)) \tag{1}$$

wherein $\phi_I(x)$ is the absolute phase offset from the first phase harmonic, I is an index for the harmonic, and x is time The above equation uses the equation:

$$\phi_I'(x)^* = \frac{Ix}{P} - \frac{k''I^2}{P^2} \tag{2}$$

This equation defines the phase relationship between the signals using a linear group delay, where $\phi'_I(x)^*$ is the absolute phase offset from the first phase harmonic, I is an index for the harmonic, x is time, P is the pitch or repetition interval, and k is a constant. The first term, Ix/P, is the phase of the harmonics if there was no group delay, i.e. if the frequency components were totally in phase. The second term, $k''I^2/P^2$, is a correction factor to create the linear group delay. Once a plurality of the $\phi'_I(x)^*$ values are computed according to equation (2), these values are inserted into equation (1) above to produce the excitation signal.

In order to compute the phase values $\phi'_I(x)^*$, it is necessary to compute the sequence.

| I | $\phi'_I(x)^*$ |
|---|---|
| 1 | $x/P - k''/P^2$ |
| 2 | $2x/P - 4k''/P^2$ |
| 3 | $3x/P - 9k''/P^2$ |
| 4 | $4x/P - 16k''/P^2$ |
| 5 | |
| . | |
| . | |
| . | |

Prior art methods perform this computation in the direct way, which requires 2 multiplications and 1 addition for each harmonic. This computation for each harmonic is undesirable because of the complexity of the equation. The present invention uses a novel system and method for computing the values for $\phi'_I(x)^*$ which minimizes computation requirements and thus improves performance. As noted above, the system and method of the present invention uses the properties of the sequence to simplify the computation and generate the terms with increased efficiency, wherein each calculation requires only two additions for each iteration. Thus the hardware required for this form of implementation is significantly simplified and the cost is significantly reduced.

The present invention performs the following iterations to compute the above sequence:

1) $\phi'_I(x)^*=\phi'_{I-1}(x)^*+A_{I-1}(x)$

2) $A_I=A_{I-1}(x)-B$ where the $A_I$values are the relative phase differences between consecutive harmonics; B is a constant of $2\ k''/P^2$, x is the time, and I is the iteration number.

This generates the following results.

| I | $\phi'_I(x)^*$ | $A_I(x)$ |
|---|---|---|
| 0 | 0 | $x/P - k''/P^2$ |
| 1 | $x/P - k''/P^2$ | $x/P - 3k''/P^2$ |
| 2 | $2x/P - 4k''/P^2$ | $x/P - 5k''/P^2$ |
| 3 | $3x/P - 9k''/P^2$ | $x/P - 7k''/P^2$ |
| 4 | . | . |
| 5 | . | . |
| | . | . |

As shown above, the $\phi'_I(x)^*$ term is the sum of the $\phi'_{I-1}(x)^*$ term and the $A_{I-1}$ term. In other words, the prior $A_I$ term is summed with the previous $\phi'_I(x)^*$ term to produce the next $\phi'_I(x)^*$ term. Each $A_I$ term is the same as the previous term with an additional $2k''/P^2$ subtracted. Thus, to obtain the next $A_I$ term, $2k''/P^2$ is subtracted from the prior $A_I$ term, i.e., the $A_{I-1}$ term. Thus the required sequence of values are generated and only one addition and subtraction are required to obtain each value. The values are obtained iteratively as illustrated above. Thus the present invention uses a relatively simple and efficient difference equation to compute the phase offset values.

After the phase offset values have been computed, cosines of the plurality of phase offset values are computed and summed to produce the excitation signal. The preferred embodiment of the invention includes a look-up table for computation of the cosines. The phase value is used to index into the look-up table, i.e., the phase corresponds to an address into the table. The excitation signal is then used in a speech production model to generate speech.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Incorporation by Reference

The following references are hereby incorporated by reference.

Kang & Everett, "Improvement of the Narrowband Linear Predictive Coder; Part 2—Synthesis Improvements," NRL Report 8799, Jun. 11, 1984 is hereby incorporated by reference in its entirety.

For general information on speech coding, please see Rabiner and Schafer, *Digital Processing of Speech Signals*, Prentice Hall, 1978 which is hereby incorporated by reference in its entirety. Please also see Gersho and Gray, *Vector Quantization and Signal Compression*, Kluwer Academic Publishers, which is hereby incorporated by reference in its entirety.

Voice Storage and Retrieval System

Figure 11:
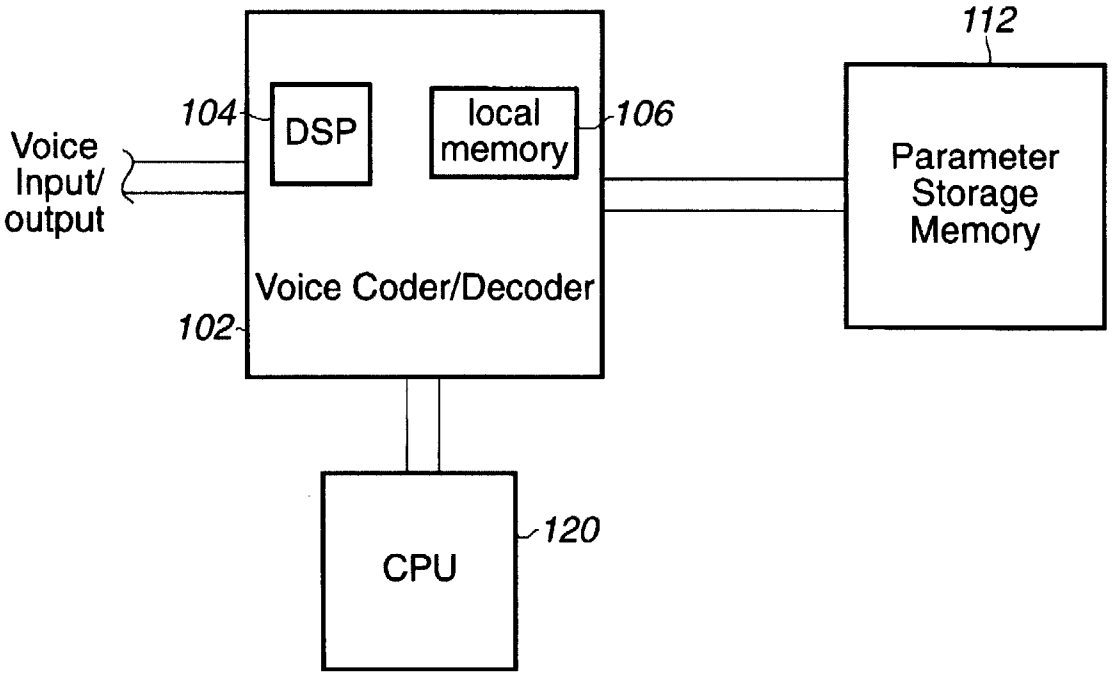
FIG. 11 is a block diagram of a speech storage system according to one embodiment of the present invention.

Referring now to FIG. 11, a block diagram illustrating a voice storage and retrieval system according to one embodiment of the invention is shown. The voice storage and retrieval system shown in FIG. 11 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (codec) 102. The voice coder/decoder 102 preferably includes a digital signal processor (DSP) 104 and local DSP memory 106. The local memory 106 serves as an analysis memory used by the DSP 104 in performing voice coding and decoding functions, i.e., voice compression and decompression, as well as parameter data smoothing. The local memory 106 preferably operates at a speed equivalent to the DSP 104 and thus has a relatively fast access time.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRY. However, it is noted that the storage memory 112 may comprise other storage media, such as a magnetic disk, flash memory, or other suitable storage media. Alternatively, the voice codec 102 is coupled to a channel for receiving analog or digital speech data.

A CPU 120 is preferably coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

Alternate Embodiment

Figure 12:
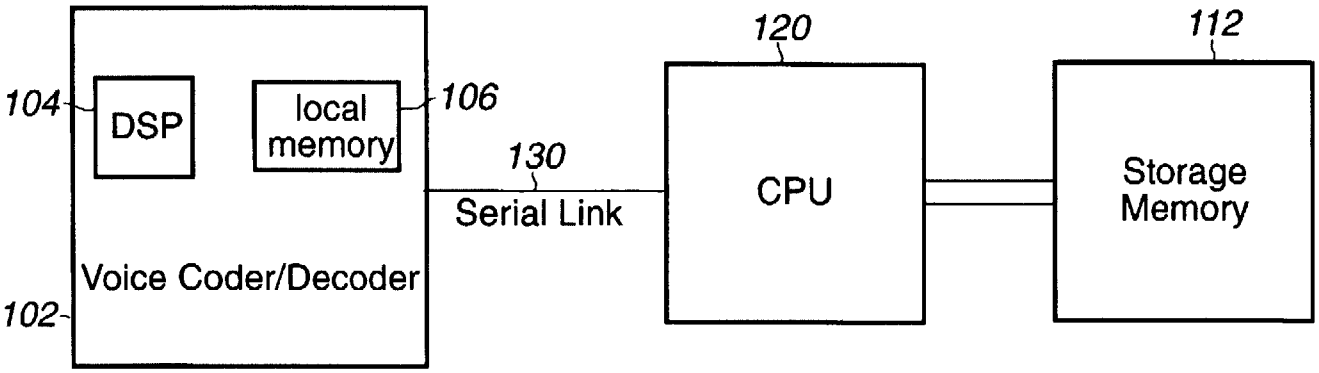
FIG. 12 is a block diagram of a speech storage system according to a second embodiment of the present invention.

Referring now to FIG. 12, an alternate embodiment of the voice storage and retrieval system is shown. Elements in FIG. 12 which correspond to elements in FIG. 11 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSP 104 controls the demand for parameters in the storage memory 112 and randomly accesses desired parameters in the storage memory 112 regardless of how the parameters are stored. The embodiment of FIG. 12 can also more closely resemble the embodiment of FIG. 11 whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Encoding Voice Data

Figure 13:
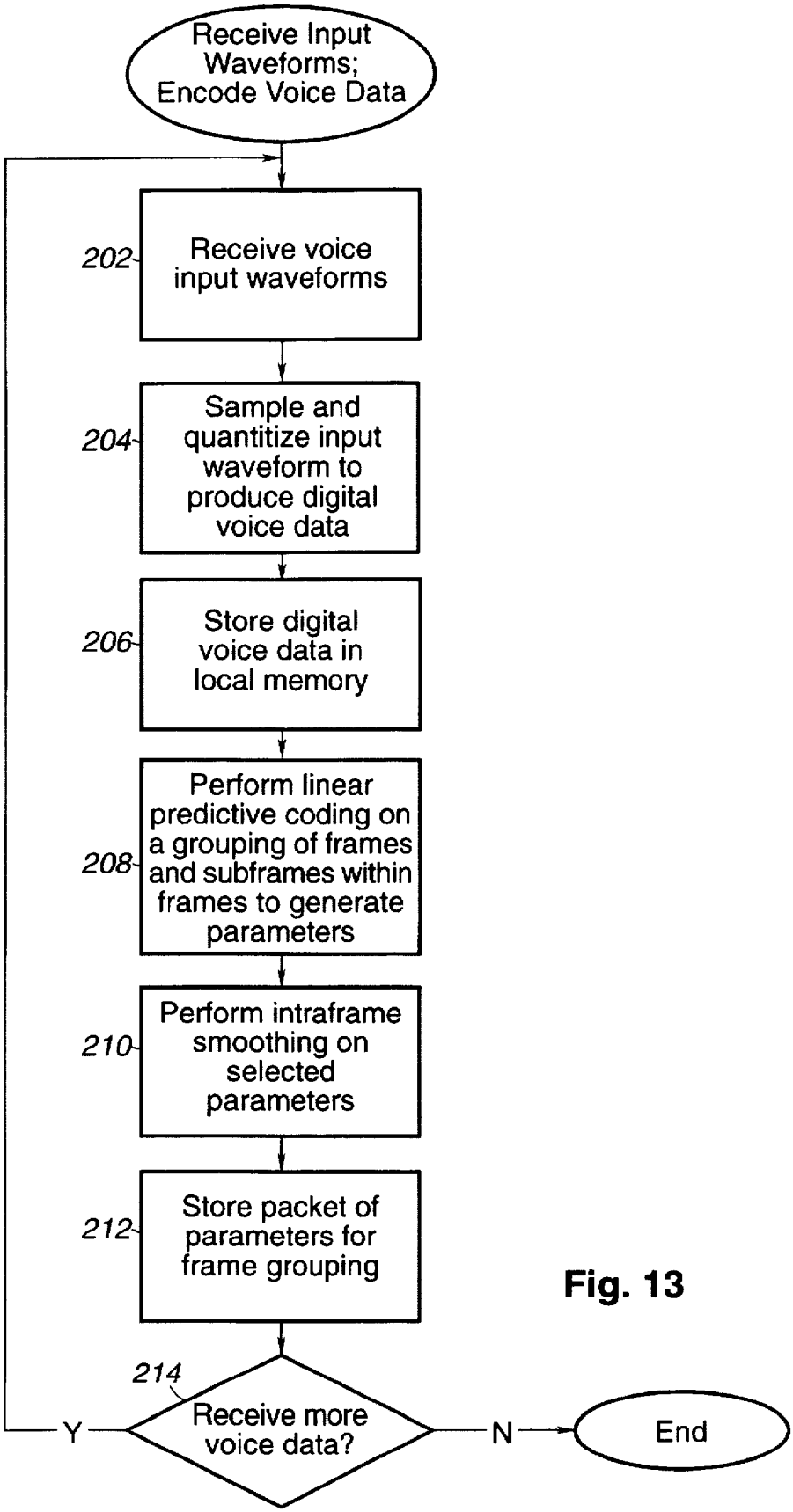
FIG. 13 is a flowchart diagram illustrating operation of speech signal encoding.

Referring now to FIG. 13, a flowchart diagram illustrating operation of the system of FIG. 11 encoding voice or speech signals into parametric data is shown. This description is included to illustrate how speech parameters are generated, and is otherwise not relevant to the present invention. It is noted that various other methods may be used to generate the speech parameters, as desired.

In step 202 the voice coder/decoder 102 receives voice input waveforms, which are analog waveforms corresponding to speech. In step 204 the DSP 104 samples and quantizes the input waveforms to produce digital voice data. The DSP 104 samples the input waveform according to a desired sampling rate. After sampling, the speech signal waveform is then quantized into digital values using a desired quantization method. In step 206 the DSP 104 stores the digital voice data or digital waveform values in the local memory 106 for analysis by the DSP 104.

While additional voice input data is being received, sampled, quantized, and stored in the local memory 106 in steps 202–206, the following steps are performed. In step 208 the DSP 104 performs encoding on a grouping of frames of the digital voice data to derive a set of parameters which describe the voice content of the respective frames being examined. Linear predictive coding is often used. However, it is noted that other types of coding methods may be used, as desired. For more information on digital processing and coding of speech signals, please see Rabiner and Schafer, *Digital Processing of Speech Signals*, Prentice Hall, 1978, which is hereby incorporated by reference in its entirety.

In step 208 the DSP 104 develops a set of parameters of different types for each frame of speech. The DSP 104 generates one or more parameters for each frame which represent the characteristics of the speech signal, including a pitch parameter, a voice/unvoice parameter, a gain parameter, a magnitude parameter, and a multi-band excitation parameter, among others. The DSP 104 may also generate other parameters for each frame or which span a grouping of multiple frames.

Once these parameters have been generated in step 208, in step 210 the DSP 104 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the DSP 104 stores this packet of parameters in the storage memory 112 in step 212. If more speech waveform data is being received by the voice coder/decoder 102 in step 214, then operation returns to step 202, and steps 202–214 are repeated.

Decoding Voice Data—Speech Generation

Figure 14:
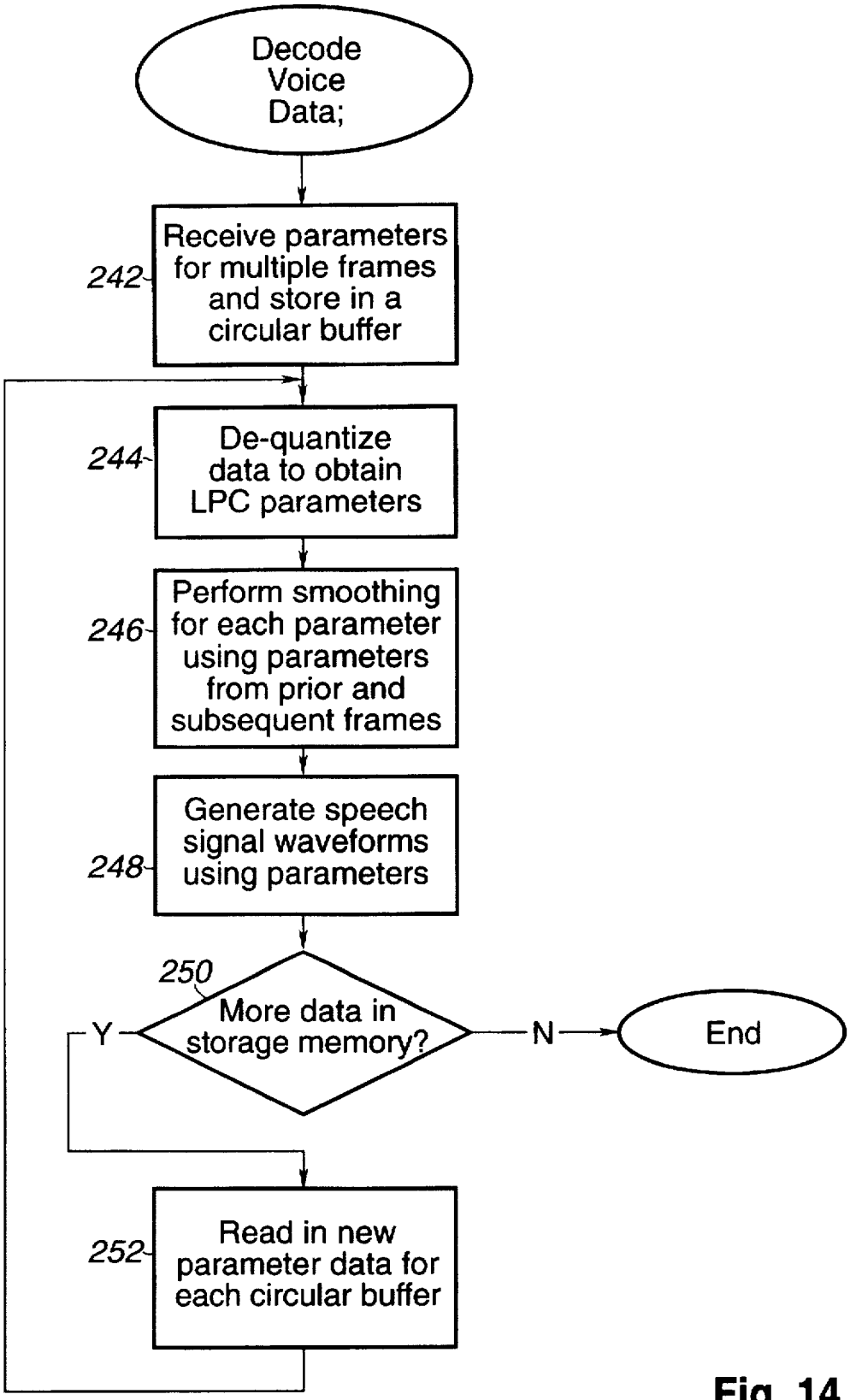
FIG. 14 is a flowchart diagram illustrating decoding of encoded parameters to generate speech waveform signals, wherein the decoding process includes generating excitation signals in a more efficient manner according to the invention.

Referring now to FIG. 14, a flowchart diagram is shown illustrating the voice decoding process, whereby the voice decoding process includes more efficient computation of excitation signals according to the present invention. In step 242 the local memory 106 receives parameters for one or more frames of speech. In step 244 the DSP 104 de-quantizes the data to obtain 1 pc parameters. For more information on this step please see Gersho and Gray, *Vector Quantization and Signal Compression*, Kluwer Academic Publishers, which is hereby incorporated by reference in its entirety.

In step 246 the DSP 104 optionally performs smoothing for respective parameters using parameters from zero or more prior and zero or more subsequent frames. As noted above, the smoothing process is optional and may not be performed, as desired. The smoothing process preferably comprises comparing the respective parameter value with like parameter values from neighboring frames and replacing discontinuities.

Figure 1:
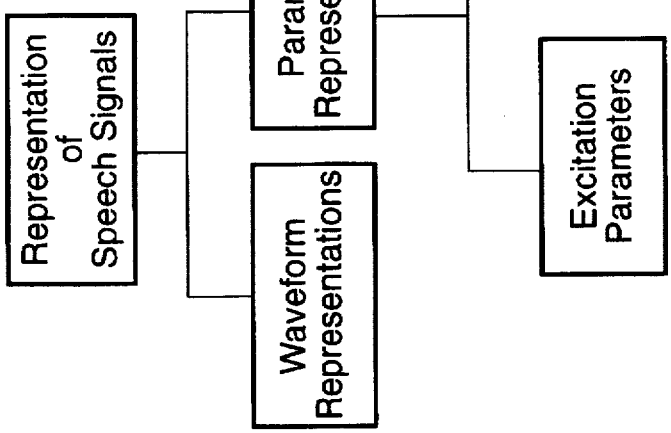
FIG. 1 (prior art)
FIG. 1 illustrates waveform representation and parametric representation methods used for representing speech signals.
Figure 2:
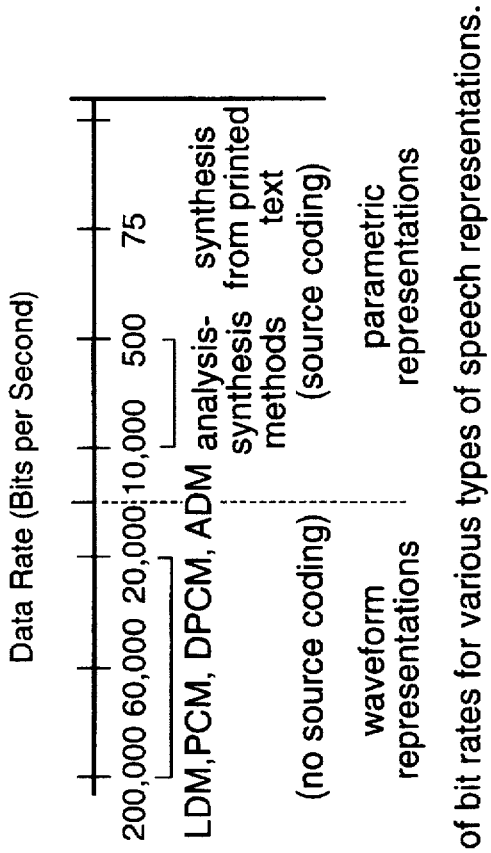
FIG. 2 (prior art)
FIG. 2 illustrates a range of bit rates for the speech representations illustrated in FIG. 1.
Figure 3:
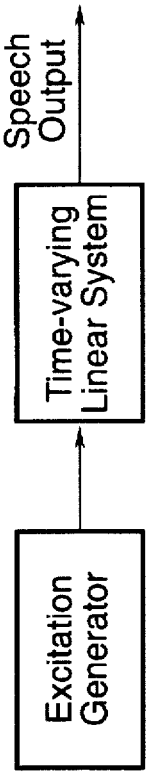
FIG. 3 (prior art)
FIG. 3 illustrates a basic model for speech production.
Figure 4:
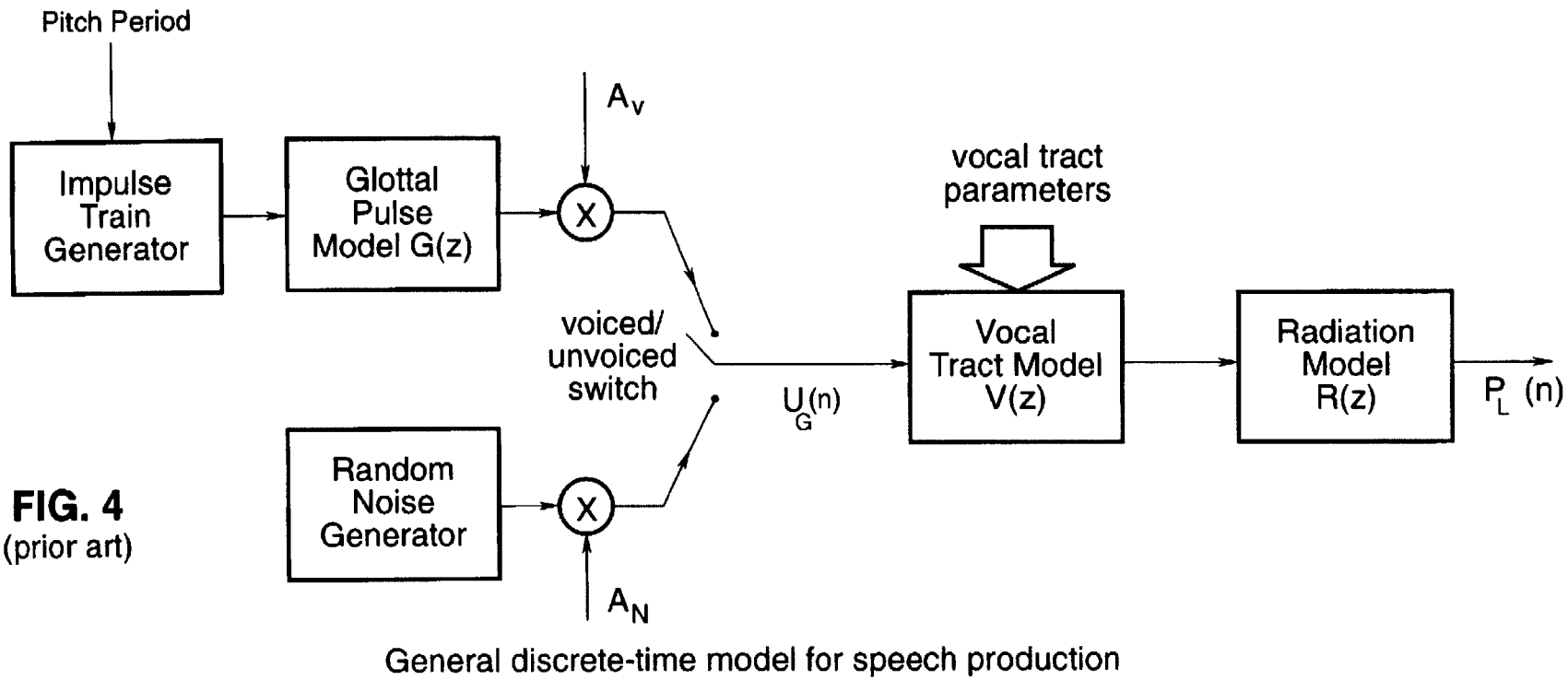
FIG. 4 (prior art)
FIG. 4 illustrates a generalized model for speech production.
Figure 5:
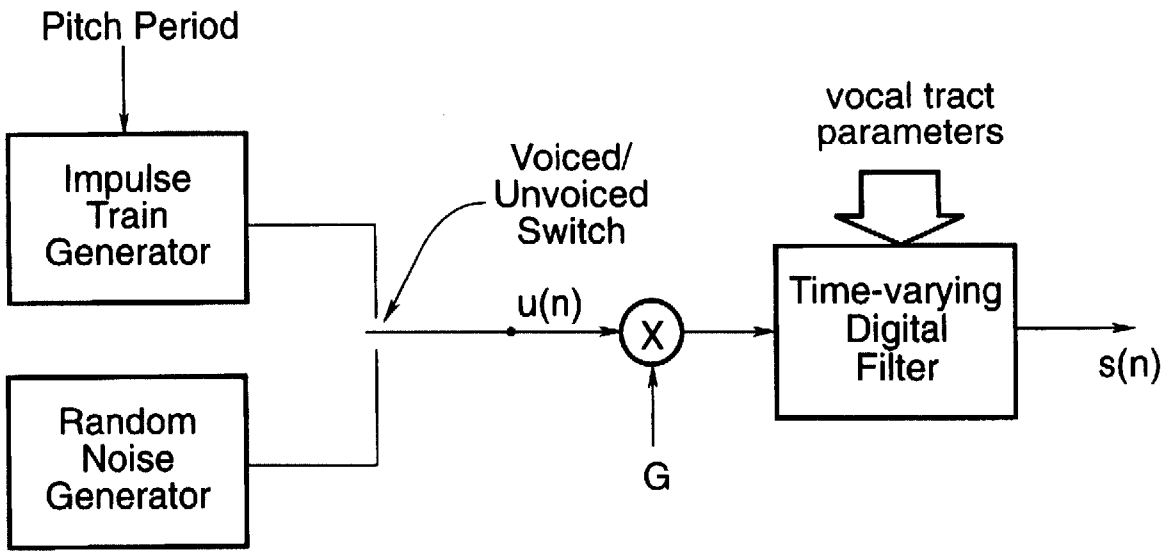
FIG. 5 (prior art)
FIG. 5 illustrates a model for speech production which includes a single time-varying digital filter.
Figure 6:
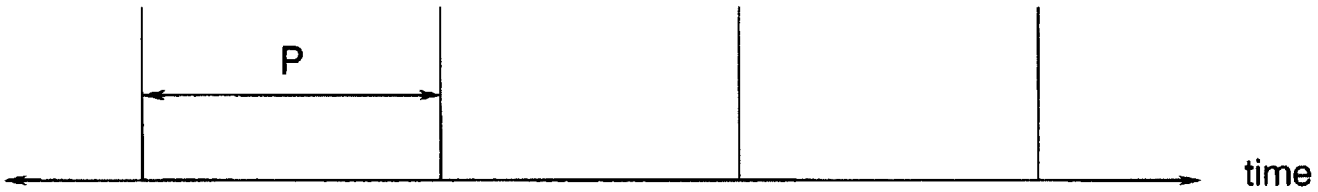
FIG. 6 illustrates excitation signals comprising a train of periodic impulses.
Figure 7:
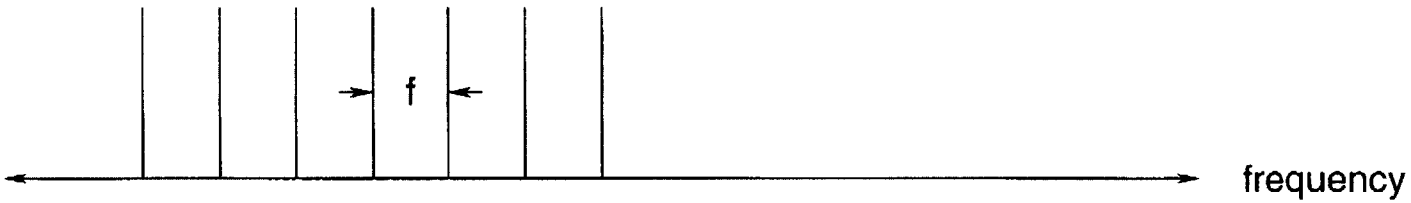
FIG. 7 illustrates the frequency spectrum of the periodic impulse train of FIG. 6.
Figure 8:
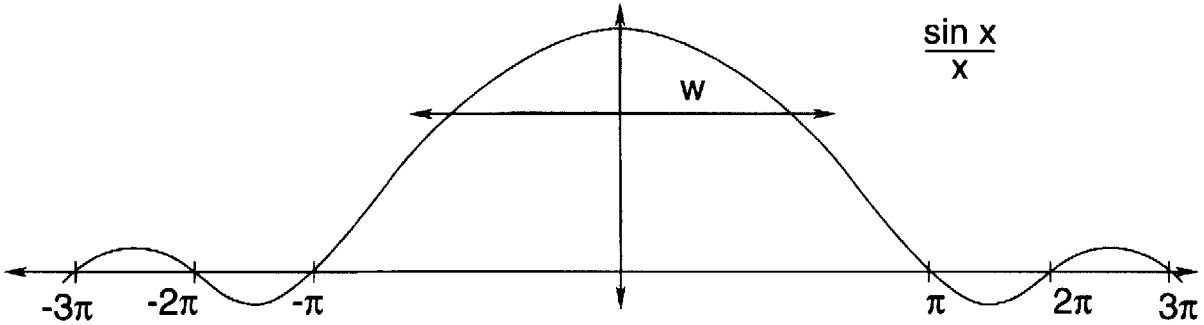
FIG. 8 illustrates an impulse as a sinc function due to a band limited frequency spectrum.
Figure 9:
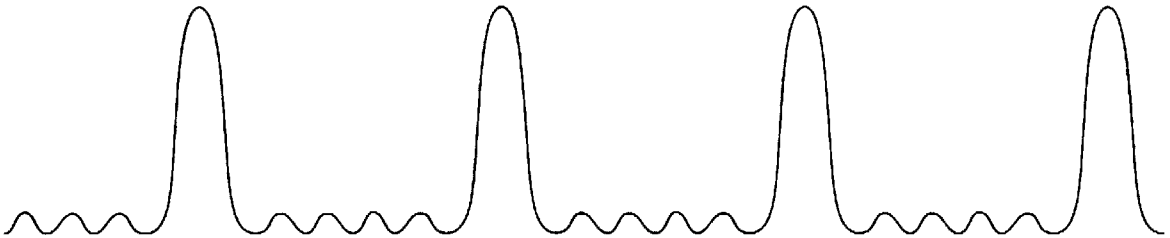
FIG. 9 illustrates a band limited version of the excitation signals of FIG. 6.

In step 248 the DSP 104 generates speech signal waveforms using the speech parameters. The speech signal waveforms are generated using a speech production model as shown in FIGS. 4 or 5. For more information on this step, please see Rabiner and Schafer, *Digital Processing of Speech Signals*, referenced above, which is incorporated herein by reference. The DSP 104 preferably computes the excitation signals for the glottal pulse model using a linear phase delay. For more information on computing excitation signals using a linear phase delay and/or by adjusting the phase spectrum of the signals, please see Kang & Everett, "Improvement of the Narrowband Linear Predictive coder Part 2—Synthesis Improvements," NRL Report 8799, Jun. 11, 1984, which was referenced above, and which is hereby incorporated by reference in its entirety.

In step 248 the DSP 104 preferably computes the excitation signals for the glottal pulse model in an efficient and optimized manner according to the present invention, as described below.

In step 250 the DSP 104 determines if more parameter data remains to be decoded in the storage memory 112. If so, in step 252 the DSP 104 reads in a new parameter value for each circular buffer and returns to step 244. These new parameter values replace the least recent prior value in the respective circular buffers and thus allows the next parameter to be examined in the context of its neighboring parameters in the eight prior and subsequent frames. If no more parameter data remains to be decoded in the storage memory 112 in step 250, then operation completes.

Generation of the Excitation Signal—Present Invention

Figure 10:
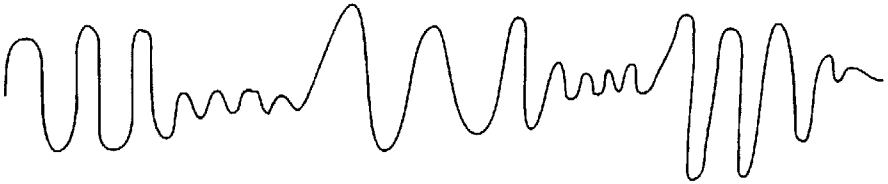
FIG. 10 illustrates excitation signals having a constant phase distortion.

As noted above, in step 248 the DSP 104 generates speech signal waveforms using the speech parameters. The speech signal waveforms are then generated using a speech production model shown in FIG. 4. In producing the speech signal waveforms, the system generates an excitation train or signal that is provided to the glottal pulse model. The present invention preferably applies a constant phase distortion to the excitation signal to produce a signal as shown in FIG. 10. The phase distortion produces a varying phase in the frequency domain, coupled with a generally constant amplitude in the frequency domain. Thus the signal is dispersed in the time domain, i.e., the signal is spread out over time.

In the preferred embodiment, the invention uses a delay of approximately 1 milliseconds for the highest frequency component, which in the system of the preferred embodiment is 3500 Hz. This has the effect of spreading the impulse over approximately 25 samples.

Generation of the excitation signal with a constant phase distortion requires the computation of a plurality of cosines, preferably a summation of cosines, as follows:

$$y(x) = \sum_{I=1}^{0.4375P} \cos(\phi_I(x)) \tag{1}$$

The above equation uses the equation:

$$\phi_I'(x)^* = \frac{Ix}{P} - \frac{k''I^2}{P^2} \tag{2}$$

This equation defines the phase relationship between the signals using a linear group delay, where $\phi'_I(x)^*$ is the absolute phase offset, I is an index for the harmonic, x is time, P is the pitch or repetition interval, and k is a constant. The first term, Ix/P, is the phase of the harmonics if there was no group delay, i.e. if the frequency components were totally in phase. The second term, $k''I^2/P^2$, is a correction factor to create the linear group delay.

Once a plurality of these values are computed, these values are inserted into equation (1) above to produce the excitation signal.

The present invention uses a novel method for computing the values for $\phi'_I(x)^*$ which minimizes computation requirements and thus improves performance.

The following describes how the above equations are derived.

Here it is assumed that the delay is r and the frequency is f. It is required that $\tau \propto f$, i.e. that $\tau = kf$.

Hence, k can be computed by knowing f for some given $\tau$. Let $\tau$ be D samples, sampled at 8000 HZ when f is 3500 HZ. Then, $$k = \frac{\tau}{f} = \frac{D}{8000} \cdot \frac{1}{3500} = \frac{D}{S} \cdot \frac{1}{3500}$$

S=8000 samples/second or 8000 Hz sampling.

The lag, in radians, $\theta$ for a given frequency f and delay $\tau$ is given by $$\begin{aligned} \theta &= 2\pi f\tau \\ &= 2\pi k f^2 \quad \text{substituting } kf \text{ for } \tau \end{aligned}$$

Thus the phase lag, for a given frequency, is proportional to the frequency squared. In a speech generation application, f is a harmonic of some fundamental frequency F, i.e. f=I F where I is a natural number, i.e., I belongs to the set {1,2,3, . . .}

Hence: $\theta_I = 2\pi k I^2 F^2$

The actual phase g of a given harmonic, I, at the current time t is denoted by $\phi_I$ and is given by $$\phi_I(t) = \Psi_I^{(t)} - \theta_I$$

where $\Psi_I^{(t)}$ is the phase of the sinusoids given that the group delay is zero for all f. hence $\Psi_I(t) = 2\pi FIt$ It is noted that $\theta_I$ is not a function of t.

In a sampled system, t is measured in samples. Let the sampling rate be S and the current sample x. Then t=x/s.

$$\text{Thus } \Psi_I(x) = \frac{2\pi FIx}{S}.$$

The F is such that p=1/F where p is the period of the fundamental frequency F in seconds and P=Sp is the period of the fundamental frequency in samples. Thus, $$P = Sp = \frac{S}{F}$$

Hence $$\Psi_I(x) = \frac{Ix}{P} \cdot 2\pi.$$

similarly $\theta_I$ can be re-written as $$\theta_I = 2\pi(F)^2 kI^2 = \frac{S^2 kI^2}{P^2} \cdot 2\pi$$

$$\begin{aligned} \text{Let } k' = S^2 k \cdot 2\pi &= 8000^2 \cdot \frac{D}{8000} \cdot \frac{2\pi}{3500} \\ &= \frac{1}{3500} \cdot \frac{D}{S} \cdot S^2 \cdot 2\pi \end{aligned}$$

Experimentally it has been found that k'=2*π* 15.625, which corresponds to D≈6.836 when S=8000, to be a useful value. This causes the pulse to be spread over approx. 25 samples in time. It is noted that, due to superposition, pulse spreading occurs over a greater time than the delay of the highest frequency.

It is also noted that this spreading operation is all pass, in the sense that the magnitude spectrum is not altered. The only change is in the phase of the signal.

$$\text{Thus } \phi_I(x) = \frac{2\pi Ix}{P} - \frac{k'I^2}{P^2}$$

In the present application, a required function that must be computed is $$y(t) = \sum_{I=1}^{\lfloor 0.4375P \rfloor} \cos(\phi_I(t))$$

-continued $$\text{or equivalently } y(x) = \sum_{l=1}^{\lfloor 0.4375P \rfloor} \cos(\phi_l(x))$$

$\lfloor k \rfloor$ denotes the nearest integer less than k, which is sometimes called the floor function.

The limit $\lfloor 0.4375\ P \rfloor$ on the range of I ensures that no aliasing is introduced in the sampled signal. Further more, this limit prevents the unnecessary computation of high frequency harmonics which would be later removed by other parts of the system.

Thus, it is necessary to compute $\phi_l(x)$ for I=1,2, . . ., $\lfloor 0.4375\ P \rfloor$ and then compute $\cos(\phi_l(x))$. This latter task is preferably computed by a look up table mechanism described below. Here it is assumed that we know $$\psi_1(x) = \frac{2\pi x}{P}$$

for some sample x.

Thus it is necessary to compute y(x) as follows to generate the proper excitation signal:

$$\text{Compute } y(x) = \sum_{l=1}^{\lfloor 0.4375P \rfloor} \cos(\phi_l(x))$$

Thus, to generate the dispersed impulse train, a summation of the cosines of different angles, referred to as $\phi_l$, is performed. The angle $\phi_l$ is a function of x (time), p (pitch), and the initial phase.

The present invention comprises an improved system and method for computing y(x) efficiently. The remainder of the development is such that implementation in binary digital hardware is illustrated. More general implementations are, however, possible.

In the preferred embodiment, cos(z) is computed by selecting the closest entry in a look up table. The look up table contains L entries. For practical reasons, $L=2^G$ where G is a natural number.

The function cos(z) takes the value of z mod $2\pi$ and uses this to compute cos(z). The look up table approximates the following function.

$$\cos^*\left(\frac{z}{2\pi} \cdot 2^G\right) = \cos(z)$$

$$\text{let } z^* = 2^G \frac{z}{2\pi}\ ;\ 0 \leqq z^* < 2^G$$

Thus, the value $\lfloor z^* \rfloor$ can be used to directly access the elements of the cos* look up table. It is noted that, to minimize representation error, the ith entry of the look up table, i=0,1,2, . . ., $2^G-1$ will actually contain cos* (i+0.5). The table look up is performed this way because it is less complex to compute $\lfloor z^* \rfloor$ than it is to round z* to the nearest integer prior to the table look up.

It is noted that the ith entry of the look-up table contains $$\cos\left(i \cdot \frac{2\pi}{2^G}\right) = \cos\left[\frac{2\pi}{2^G}\left[\frac{z \cdot 2^G}{2\pi} + 0.5\right]\right] \approx \cos z$$

Thus, a mechanism is required to compute $\phi_l(x)^*$ for I=1, 2,3, . . ., $\lfloor 0.4375\ P \rfloor$ $$\phi_l(x)^* = \frac{\phi_l(x)2^G}{2\pi} = \frac{lx2^G}{P} - \frac{k'l2^G}{P^2 2\pi}$$

$$\text{letting } k'' = \frac{k'}{2\pi} \text{ provides}$$

$$\phi_l(x)^* = \left(\frac{lx}{P} - \frac{k''l2}{P^2}\right)2^G$$

The multiplication by $2^G$ corresponds only to a shift in the binary point by G places to the left. This pertains only to the perceived scale of the result.

For notational convenience, the following function is used $$\phi_l'(x)^* = \phi_l(x)^*/2^G = \frac{lx}{P} - \frac{k''l2}{P^2}$$

This equation illustrates the phase relationship between different values in order to compute a linear group delay. The above equation is derived from the definition of linear group delay.

It is noted that a property of $\phi'_l(x)^*$ is that $0 \leqq \phi'_l(x)^* < 1$. Any value outside these limits is reduced modulo 1.

Operation of the Present Invention

Therefore, to summarize, generation of the excitation signal with a constant phase distortion requires the computation of a plurality of cosines, preferably a summation of cosines, as follows:

$$y(x) = \sum_{l=1}^{0.4375p} \cos(\phi_l(x)) \tag{1}$$

The above equation uses the equation:

$$\phi_l'(x)^* = \frac{lx}{P} - \frac{k''l2}{P^2} \tag{2}$$

$$\text{Let } \psi_l'(x)^* = \frac{lx}{P}\ \&$$

$$\phi_l'(x)^* = \frac{k''l2}{P^2}$$

then $\phi'_l(x)^* = \Psi'_l(x)^* - \phi'_l(x)^*$.

In order to compute the phases, it is necessary to compute the sequence.

| I | $\phi'_l(x)^*$ |
|---|---|
| 1 | $x/P - k''/P^2$ |
| 2 | $2x/P - 4k''/P^2$ |
| 3 | $3x/P - 9k''/P^2$ |
| 4 | $4x/P - 16k''/P^2$ |
| 5 | |
| . | |
| . | |
| . | |

Prior art methods perform this computation in the direct way, which requires 2 multiplications and 1 difference for each harmonic. This computation for each harmonic is undesirable because of the complexity of the equation. The present invention uses a more efficient system and method for computing the above phase values. Since it is necessary to compute the harmonics in sequence, the system and method of the present invention uses the properties of the sequence to simplify the computation and generate the terms with increased efficiency. Thus the present invention requires only two additions, i.e., an addition and a subtraction. Thus the hardware required for this form of implementation is significantly simplified and the cost is significantly reduced.

Let $\phi_1'(x)^* = 0$

Let $A_0(x) = x/P - k''/P^2$

Let $B = 2k''/P^2$

The present invention performs the following iterations to compute the above sequence:

1) $\phi'_I(x)^*=\phi'_{I-1}(x)^*+A_{I-1}(x)$

2) $A_I=A_{I-1}(x)-B$ where the $A_I$ values are the relative phase differences between consecutive harmonics; the $\phi'_I(x)^*$ values are the relative phase differences between the current harmonic and the previous harmonic; B is a constant of 2 $k''/P^2$, x is the time, and I is the iteration number.

This generates the following results.

| I | $\phi'_I(x)^*$ | $A_I(x)$ |
|---|---|---|
| 0 | 0 | $x/P - k''/P^2$ |
| 1 | $x/P - k''/P^2$ | $x/P - 3k''/P^2$ |
| 2 | $2x/P - 4k''/P^2$ | $x/P - 5k''/P^2$ |
| 3 | $3x/P - 9k''/P^2$ | $x/P - 7k''/P^2$ |
| 4 | . | . |
| 5 | . | . |
| | . | . |

As shown above, the $\phi'_I(x)^*$ term is the sum of the $\phi'_{I-1}(x)^*$ term and the $A_{I-1}$ term. In other words, the prior $A_I$ term is summed with the previous $\phi'_I(x)^*$ term to produce the next $\phi'_I(x)^*$ term. Each $A_I$ term is the same as the previous term with an additional $2k''/P^2$ subtracted. Thus, to obtain the next $A_I$ term, $2k''/P^2$ is subtracted from the prior $A_I$ term, i.e., the $A_{I-1}$ term. Thus the required sequence of values are generated and only one addition and subtraction are required to obtain each value. The values are obtained iteratively as illustrated above. Thus the present invention uses a relatively simple and efficient difference equation to compute the phase offset values.

The preferred embodiment of the invention includes a look-up table for computation of the cosines. The phase value is used to index into the look-up table, i.e., the phase corresponds to an address into the table to obtain the corresponding cosine values. The summing unit for $\phi'_I(x)^*$ is constructed so that the modulo reduction is inherently generated as overflow bits are discarded.

Figure 15:
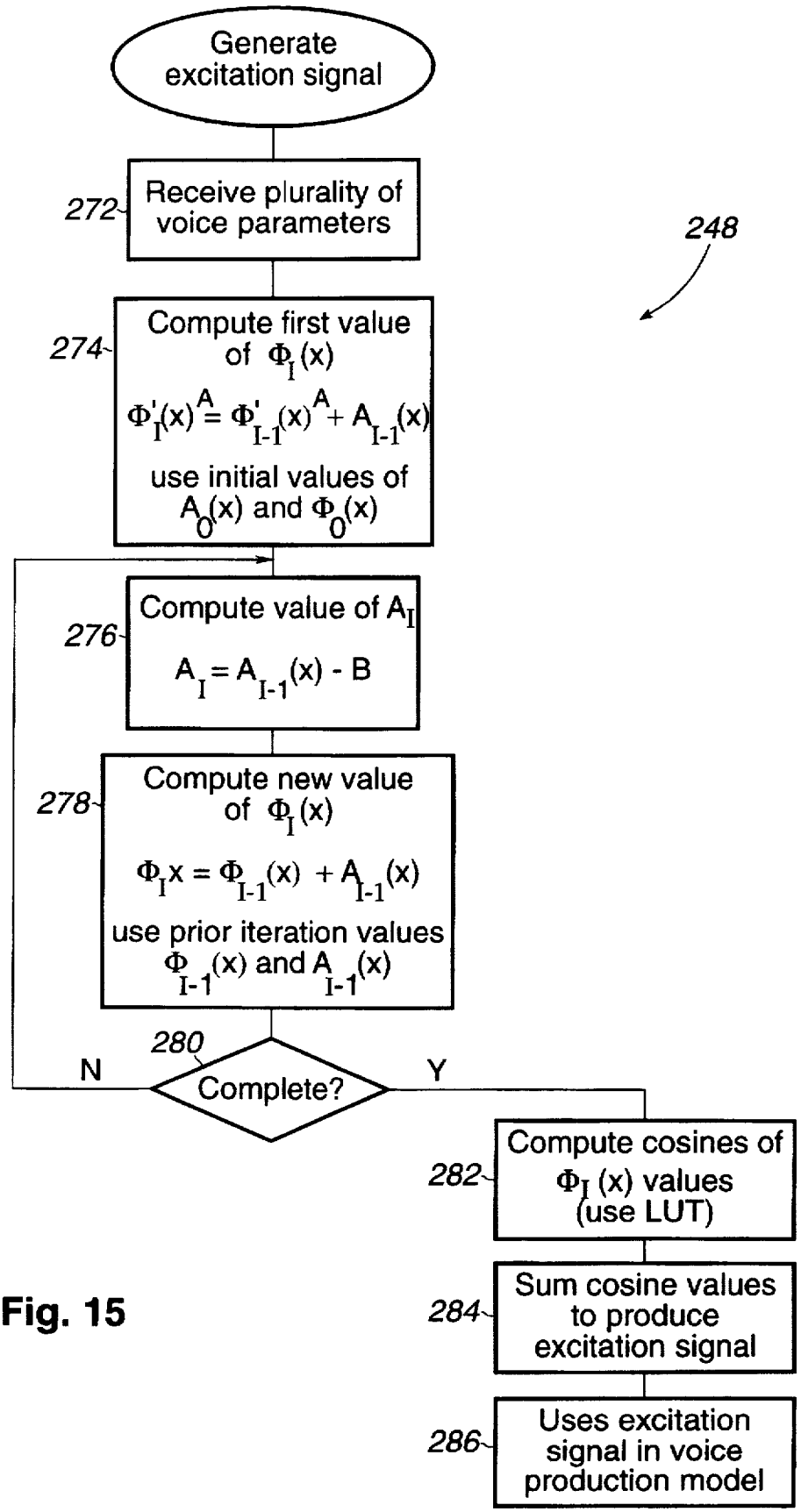
FIG. 15 is a flowchart diagram illustrating operation of the present invention.

Flowchart Diagram—FIG. 15

Referring now to FIG. 15, a flowchart diagram is shown illustrating a method for generating an excitation signal for a speech production model according to the present invention. The method is preferably implemented using a digital signal processor (DSP) and/or dedicated circuitry. As shown, in step 272 the method receives a plurality of voice parameters. In step 274 the method computes a first value of $\phi'_I(x)^*$ according to the equation: $\phi'_I(x)^*=\phi'_{I-1}(x)^*+A_{I-1}(x)$. In computing the first value of $\phi'_I(x)^*$, the method uses stored values of $\phi'_{I-1}(x)^*$ and $A_{I-1}(x)$, i.e., $\phi'_I(x)^*$ and $A_0(x)$. The initial value of $A_0$ is preferably: $x/p-k''/p^2$. The initial value of $\phi'_0$ is preferably 0.

In step 276 the method computes a value of $A_I$ according to the equation: $A_I=A_{I-1}(x)-B$. As noted above, the constant B is preferably 2 $k''/P^2$. Also, as noted above, the $A_I$ term is used principally for efficiently computing the $\phi_I$ terms.

In step 278 the method computes a new value of $\phi'_I(x)^*$ according to the equation: $\phi'_I(x)^*=\phi'_{I-1}(x)^*+A_{I-1}(x)$. The computation performed in step 278 uses the prior iteration values of $\phi'_I(x)^*$ and $A_I(x)$. Thus this step uses the prior iteration value of $A_I$ computed in step 276. Also, if this is the second iteration of $\phi'_I(x)^*$, the method uses the prior $\phi'_I(x)^*$ value computed in step 274. Otherwise, the method uses the value of $\phi'_I(x)^*$ computed in a prior iteration of step 278. It is noted that step 278 preferably includes a step of reducing each of the phase offset values $\phi'_I(x)^*$ by modulo $2^G$ after calculating the phase offset $\phi'_I(x)^*$. Steps 276 and 278 preferably repeat to compute a plurality of phase offset values $\phi'_I(x)^*$.

After the phase offsets have been computed, in step 282 the system computes cosines of the $\phi'_I(x)^*$ values. In the preferred embodiment, the system includes a look-up table which stores cosine values. The $\phi'_I(x)^*$ values are used to index into the look-up table to obtain the respective cosine values. For example, in one embodiment the local memory 106 in the codec 102 includes the look-up table comprising cosine values. Other hardware may be used for calculating the cosines of the $\phi'_I(x)^*$ values, such as a direct computation of the cosines using digital circuitry. It is also noted that the cosines of each of the phase offsets can be computed immediately after each respective phase offset is computed in step 278 (and step 274), as desired.

In step 284 the system or method sums the cosine values to produce the excitation signal. As a result of the above steps, the system has calculated the following equation:

$$y(x) = \sum_{I=1}^{0.4375P} \cos(\phi_I(x))$$

In step 286 the system uses the excitation signal in the voice production model. As noted above, the excitation signal is a periodic signal with flat frequency response and linear group delay. This flowchart (i.e. FIG. 15) comprises a portion of step 248 of FIG. 14. The excitation signal is preferably provided as the excitation signal to the glottal pulse model in the voice production model, as is known in the art.

Hardware Diagram

Figure 16:
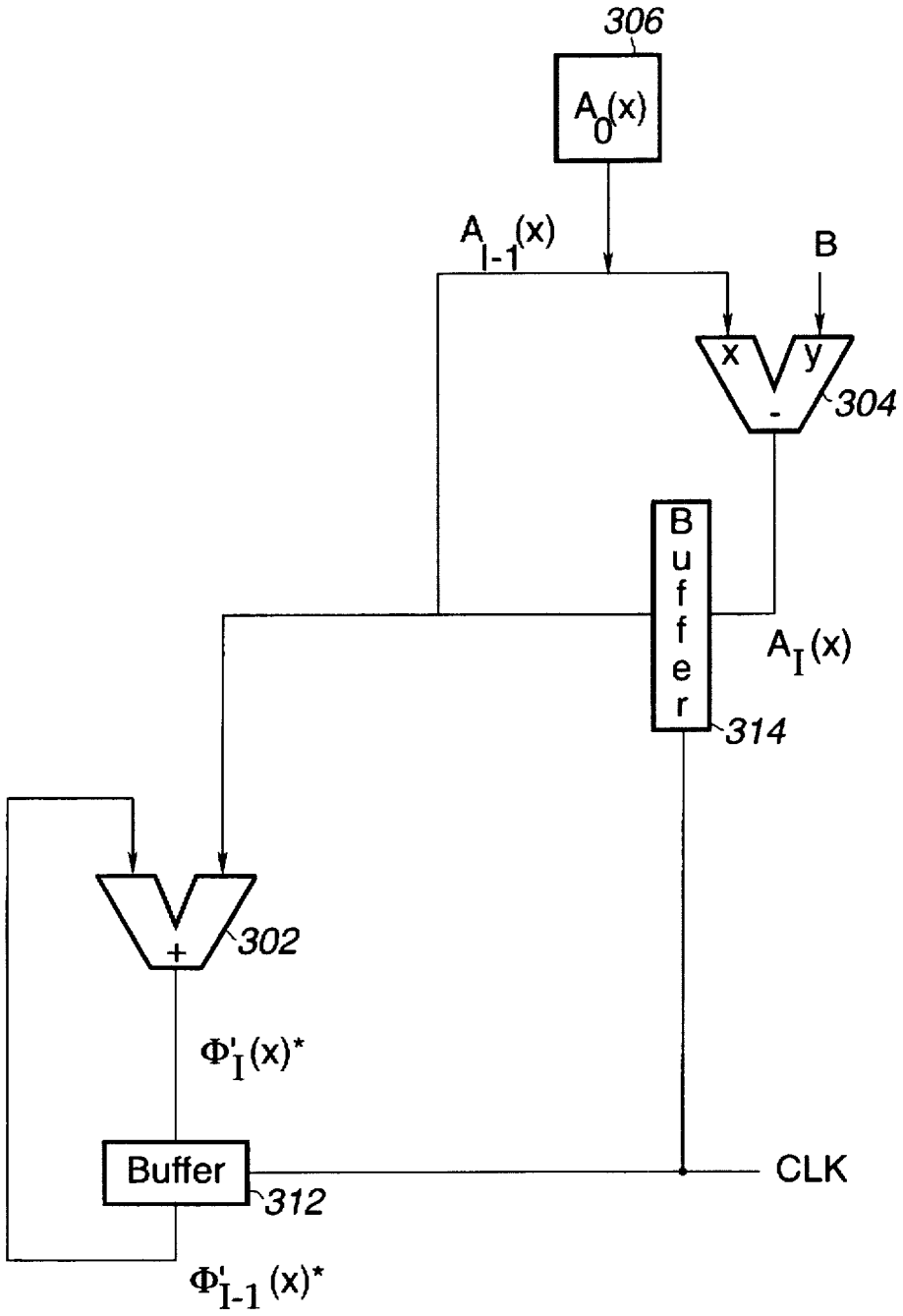
FIG. 16 is a hardware diagram illustrating the preferred embodiment for efficiently generating the phase delay values according to the present invention.

Referring now to FIG. 16, a system for generating an excitation signal for a speech production model according to the present invention is shown. As shown, the system includes a means for computing a sequence of values for $\phi'_I(x)^*$, preferably two adders. The system computes a phase difference value $A_I$, wherein the phase difference value $A_I$ is a phase difference between adjacent harmonics. As mentioned above, the phase difference is computed using the following equation:

$$A_I=A_{I-1}(x)-B$$

The system includes a first adder 302 and a second adder 304. The first adder 302 includes a first input for receiving the computed phase difference term $A_{I-1}(x)$ and includes a second input. The first adder 302 also includes an output for producing the phase offset value $\phi'_I(x)^*$. The output of the first adder 302 is connected to a buffer 312. The output of the buffer 312 is the value $\phi'_I(x)^*$, which is provided to the second input of the first adder 302 to provide the prior phase offset term value to the second input of the first adder 302. Thus the phase offset value $\phi'_I(x)^*$ is computed as follows.

$$\phi'_I(x)^*=\phi'_{I-1}(x)^*+A_{I-1}(x)$$

The second adder 304 includes a first or y input for receiving a constant B and includes a second input or x input. The constant B is preferably the value $2k'/P^2$. The second adder 304 includes an output for producing the computed phase difference $A_I(x)$. The output of the second adder 304 is provided to a buffer 314, and the output of the buffer 314 is provided to an input of the adder 302. The output of the buffer 314 is also connected to the second input of the second adder 304 to provide the computed phase difference $A_{I-1}(x)$ to the second input of the second adder 304. The adder 304 subtracts the first input from the second input, i.e., performs an x-y operation on the inputs to the adder 304. A memory element 310 which stores an initial value for $A_0(x)$ is also coupled to the second input of the adder 304 to provide an initial $A_0(x)$ value to the adder 304. As noted above, the initial value of $A_0(x)$ is $x/p-k''/P^2$.

Thus the first adder 302 sums a phase offset value $\phi'_{I-1}(x)^*$ with the computed phase difference $A_{I-1}(x)$ to produce a new phase offset value $\phi'_I(x)^*$. The second adder 304 subtracts a constant $$\frac{2k''}{P^2}$$

from the computed phase difference term $A_{I-1}(x)$ to produce a new phase difference $A_I(x)$. The first and second adders 302 and 304 alternatively and repeatedly operate for a plurality of times to produce a plurality of phase offset values as described above.

A read input is provided to each of the buffers 312 and 314. Thus when the circuit is read, latches are opened and the combinatorial logic operates. The buffers provide a brake in the circuit to ensure orderly operation. At particular time instants specified by the clock signal, when the buffer inputs are all valid and the circuit is stable, the values at the inputs to the buffer are transferred to the outputs. The transfer causes the next iteration to occur. In an alternate embodiment, the logic operates according to the edge of a clock signal.

Thus the desired phases for the successive harmonics are conveniently and efficiently computed, and a signal with a linear group delay based on the generated phases is produced. The value of $\phi'_I(x)^*$ is preferably applied directly to access the cosine look-up table. The reduction of modulo $2^G$ of the value $\phi'_I(x)^*$ is preferably performed by summation unit 306 by discarding overflow bits. The summation unit operates on values in the range of $2^G-1$. In one embodiment, the summation unit 306 is 2's complement and operates over the range $$\frac{-2^G}{2} < x < \frac{2^G}{2} - 1).$$

As mentioned above, the present invention also includes a look-up table for producing cosines of the plurality of phase offset values. The present invention further includes a means for summing the cosines of the plurality of phase offset values to produce the excitation signal.

Conclusion

Therefore a system and method for generating excitation signals for a speech production model with improved computational efficiency is shown and described. The system and method of the present invention performs the required computations using only two adders, thus simplifying the hardware and improving performance.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A method for generating speech waveforms comprising:

receiving a plurality of voice parameters which correspond to encoded speech, wherein said plurality of voice parameters include a pitch parameter P;

calculating an excitation signal using said pitch parameter P;

generating said speech waveforms using said excitation signal and said plurality of voice parameters;

wherein said calculating an excitation signal using said pitch parameter P comprises:

summing a phase offset value $\phi'_{I-1}(x)^*$ with a phase difference value $A_{I-1}$ to produce a new phase offset value $\phi'_I(x)^*$, wherein said phase difference value $A_{I-1}$ is a relative phase difference between adjacent harmonics of said excitation signal, wherein said excitation signal has a period determined by pitch parameter P, wherein x is time, and wherein pitch parameter P is the pitch period;

subtracting a constant from said computed phase difference value $A_{I-1}$ to produce a new phase difference $A_I$;

repeating said steps of summing and subtracting for successive values of index I to produce a plurality of phase offset values $\phi'_I(x)^*$;

computing cosines of said plurality of phase offset values; and summing said cosines of said plurality of phase offset values to produce said excitation signal.

2. The method of claim 1, wherein $\phi'_I(x)^*$ is the instantaneous phase of the $I^{th}$ harmonic of said excitation signal.

3. The method of claim 1, wherein said calculating an excitation signal further comprises:

storing an initial phase difference value $A_0$, wherein said initial phase difference value $A_0$ has the form $x/P-k''/P^2$;

wherein k" is a constant; and wherein a first iteration of said summing said phase offset value $\phi'_I(x)^*$ with said phase difference value $A_{I-1}$ to produce a new phase offset value $\phi'_I(x)^*$ uses initial phase difference value $A_0$.

4. The method of claim 1, wherein said summing said phase offset value $\phi'_I(x)^*$ with said phase difference value $A_{I-1}$ to produce a new phase offset value $\phi'_I(x)^*$ operates according to the equation:

$$\phi'_I(x)^*=\phi'_{I-1}(x)^*+A_{I-1}(x)$$

where x is time and I is an index for the harmonic.

5. The method of claim 1, wherein said subtracting a constant from said computed phase difference value $A_{I-1}$ to produce anew phase difference $A_I$ operates according to the equation:

$$A_I=A_{I-1}(x)-B$$

where B is a constant, and I is an index for the harmonic.

6. The method of claim 1, wherein said calculating an excitation signal further comprises:

reducing each of said phase offset values $\phi'_I)x)^*$ modulo $2^G$ before computing cosines of said plurality of phase offset values.

7. The method of claim 1, wherein said summing said phase offset value $\phi'_{I-1}(x)^*$ with said phase difference value $A_{I-1}$ to produce a new phase offset value $\phi'_I(x)^*$ operates according to the equation:

$$\phi'_I(x)^*=\phi'_{I-1}(x)^*+A_{I-1}(x)$$

where x is time and I is an index for the harmonic.

8. The method of claim 1, wherein said subtracting a constant from said computed phase difference value $A_{I-1}$ to produce a new phase difference $A_I$ operates according to the equation:

$$A_I=A_{I-1}(x)-B$$

where B is a constant, I is an index for the harmonic.

9. The method of claim 1, wherein said phase offset values $\phi'_I(x)^*$ take the form

| I | $\phi'_I(x)^*$ |
|---|---|
| 1 | $x/P - k''/P^2$ |
| 2 | $2x/P - 4k''/P^2$ |
| 3 | $3x/P - 9k''/P^2$ |
| 4 | $4x/P - 16k''/P^2$ |
| 5 | |
| . | |
| . | |
| . | |

wherein x is time, P is the pitch period, and k is a constant.

10. The method of claim 1, wherein said computed phase offset values $\phi'_I(x)^*$ and said computed phase difference values $A_I$ take the form:

| I | $\phi'_I(x)^*$ | $A_I(x)$ |
|---|---|---|
| 0 | 0 | $x/P - k''/P^2$ |
| 1 | $x/P - k''/P^2$ | $x/P - 3k''/P^2$ |
| 2 | $2x/P - 4k''/P^2$ | $x/P - 5k''/P^2$ |
| 3 | $3x/P - 9k''/P^2$ | $x/P - 7k''/P^2$ |
| 4 | . | . |
| 5 | . | . |
| | . | . |

wherein I is the index for the harmonic, x is time, P is the pitch period, and k" is a constant.

11. The method of claim 1, said calculating an excitation signal further comprises:

applying said excitation signal as input to a speech production model to produce said speech waveforms, wherein said plurality of voice parameters determine the response of said speech production model.

12. A vocoder system for generating an excitation signal for a speech production model, wherein the vocoder system receives a plurality of voice parameters which correspond to encoded speech, wherein said vocoder system comprises:

a first adder which includes inputs receiving a phase offset value $\phi'_{I-1}(x)^*$ and a phase difference value $A_{I-1}$, wherein said first adder sums said phase offset value $\phi'_{I-1}(x)^*$ with said phase difference value $A_{I-1}$ to produce a new phase offset value $\phi'_I(x)^*$, wherein $\phi'_I(x)^*$ is the instantaneous phase of the $I^{th}$ harmonic of said excitation signal;

a second adder which includes inputs receiving said phase difference value $A_{I-1}$ and a constant, wherein said second adder produces a new phase difference value $A_I$, wherein said phase difference value $A_I$ is a relative phase difference between adjacent harmonics of said excitation signal; and wherein said first and second adders concurrently and repeatedly operate for a plurality of times to produce a plurality of phase offset values;

means for producing cosine values of said plurality of phase offset values; and means for summing said cosine values of said plurality of phase offset values to produce said excitation signal.

13. The vocoder system of claim 12, wherein said first adder includes a first input for receiving said computed phase difference $A_{I-1}$ and includes a second input, wherein said first adder includes an output for producing said phase offset value $\phi'_I(x)^*$, wherein said output of said first adder is connected to said second input of said first adder to provide said new phase offset value to said second input of said first adder;

wherein said second adder includes a first input for receiving said constant and includes a second input, wherein said second adder includes an output for producing said computed phase difference $A_I$, wherein said output of said second adder is connected to said second input of said second adder to provide said new computed phase difference to said second input of said second adder.

14. The vocoder system of claim 12, further comprising:

a first buffer coupled to said output of said first adder which receives said phase offset value $\phi'_I(x)^*$, wherein said first buffer provides said phase offset value $\phi'_{I-1}(x)^*$ to an input of said first adder; and a second buffer coupled to said output of said second adder which receives said phase difference value $A_I$ wherein said second buffer provides said phase difference $A_{I-1}$ to an input of said second adder.

15. The vocoder system of claim 12, wherein said second adder subtracts said constant from said computed phase difference value $A_{I-1}$ to produce a new phase difference $A_I$.

16. The vocoder system of claim 12, wherein said constant comprises:

$$\frac{2k''}{P^2};$$

wherein $\phi'_I(x)^*$ is the absolute phase offset from the first phase harmonic, x is time, P is the pitch, and k" is a constant.

17. The vocoder system of claim 12, wherein said means for summing said cosine values of said plurality of phase offset values to produce said excitation signal produces an excitation signal with a linear group delay.

18. The vocoder system of claim 12, wherein said means for producing said cosine values of phase offset values comprises a look-up table storing cosine values, wherein said mean for producing applies said phase offset values $\phi'_I(x)^*$ to said look-up table storing cosine values.

19. The vocoder system of claim 12, further comprising:

means for reducing each of said phase offset values $\phi'_I(x)^*$ by modulo $2^G$ after operation of said means for summing to produce a new phase offset value $\phi'_I(x)^*$.

20. The vocoder system of claim 12, wherein said first adder produces a new phase offset value $\phi'_I(x)^*$ according to the equation:

$$\phi'_I(x)^*=\phi'_{I-1}(x)^*+A_{I-1}(x)$$

where x is the time and I is an index for the harmonic.

21. The vocoder system of claim 12, wherein said second adder produces a new phase difference $A_I$ according to the equation:

$$A_I = A_{I-1}(x) - B$$

where B is a constant and I is an index for the harmonic.

22. The vocoder system of claim 12, wherein said computed phase offset values $\phi'_I(x)^*$ and said computed phase difference values $A_I$ take the form:

| I | $\phi'_I(x)^*$ | $A_I(x)$ |
|---|---|---|
| 0 | 0 | $x/P - k''/P^2$ |
| 1 | $x/P - k''/P^2$ | $x/P - 3k''/P^2$ |
| 2 | $2x/P - 4k''/P^2$ | $x/P - 5k''/P^2$ |
| 3 | $3x/P - 9k''/P^2$ | $x/P - 7k''/P^2$ |
| 4 | . | . |
| 5 | . | . |
| | . | . |

wherein I is the index for the harmonic, x is time, P is the pitch, and k" is a constant.

23. A method for generating an excitation signal for a speech production model, comprising:

receiving a plurality of voice parameters which correspond to encoded speech waveforms, wherein said plurality of voice parameters includes a pitch parameter P;

summing a phase offset value $\phi'_{I-1}(x)^*$ with a phase difference value $A_{I-1}$ to produce a new phase offset value $\phi'_I(x)^*$, wherein said phase difference value $A_{I-1}$ is a relative phase difference between adjacent harmonics of an impulse train signal having a period P, wherein $\phi'_I(x)^*$ is the absolute phase offset from the first phase harmonic of the impulse train signal, x is time, P is the pitch period, and k" is a constant;

subtracting a constant from said computed phase difference value $A_{I-1}$ to produce a new phase difference $A_I$;

repeating said steps of summing and subtracting using said new phase offset value $\phi'_I(x)^*$ and said new phase difference $A_I$ to produce a plurality of phase offset values;

computing cosines of said plurality of phase offset values; and summing said cosines of said plurality of phase offset values to produce said excitation signal;

generating speech waveforms using said excitation signal, wherein said generated speech waveforms approximate said encoded speech waveforms.

24. The method of claim 23, further comprising:

storing an initial phase difference value $A_O$, wherein said initial phase difference value $A_O$ comprises: $x/P - k''/P^2$;

wherein x is time, P is the pitch, and k" is a constant; and wherein a first iteration of said summing said phase offset value $\phi'_{I-1}(x)^*$ with said phase difference value $A_{I-1}$ to produce a new phase offset value $\phi'_I(x)^*$ uses initial phase difference value $A_O$.

25. The method of claim 23, wherein said computing cosines of said plurality of phase offset values comprises applying said phase offset values $\phi'_I(x)^*$ to a look-up table storing cosine values.

26. The method of claim 23, wherein said summing said phase offset value $\phi'_{I-1}(x)^*$ with said phase difference value $A_{I-1}$ to produce a new phase offset value $\phi'_I(x)^*$ operates according to the equation:

$$\phi'_I(x)^* = \phi'_{I-1}(x)^* + A_{I-1}(x)$$

where x is the time and I is an index for the harmonic.

27. The method of claim 23, wherein said subtracting a constant from said computed phase difference value $A_{I-1}$ to produce a new phase difference $A_I$ operates according to the equation:

$$A_I = A_{I-1}(x) - B$$

where B is a constant, and I is an index for the harmonic.

* * * * *

UNITED STATES PATENT AND TRADEMARK OFFICE

CERTIFICATE OF CORRECTION

PATENT NO. : 5,778,337

DATED : July 7, 1998

INVENTOR(S) : Mark A. Ireton

It is certified that error appears in the above-identified patent and that said Letters Patent is hereby corrected as shown below:

In the Claims:

Claim 4, col. 16, line 48, please delete "$\phi'_I(x)^*$ " and substitute "$\phi'_{I-1}(x)^*$".

Claim 6, col. 16, line 65, please delete "$\phi'_I)x)^*$" and substitute "$\phi'_I(x)^*$".

Claim 9, col. 17, line 31, please delete "and k is" and substitute "and k" is".

Signed and Sealed this

Thirteenth Day of October 1998

*Attest:*

*Attesting Officer*

BRUCE LEHMAN

*Commissioner of Patents and Trademarks*